US006116594A

United States Patent [19]

Boost

[11] Patent Number: 6,116,594

[45] Date of Patent: Sep. 12, 2000

[54] SHEET REGISTRATION DEVICE

[75] Inventor: Paul Boost, Stevenage, United Kingdom

[73] Assignee: Xerox Corporation, Stamford, Conn.

[21] Appl. No.: 09/383,436

[22] Filed: Aug. 27, 1999

[30] Foreign Application Priority Data

Aug. 28, 1998 [GB] United Kingdom ..... 9818928

[51] Int. Cl.[7] ..... B65H 9/00

[52] U.S. Cl. ..... 271/236; 271/241

[58] Field of Search ..... 271/226, 236, 271/241, 245

[56] References Cited

U.S. PATENT DOCUMENTS 4,359,219 11/1982 Garavuso ..... 271/236

4,589,654 5/1986 Kanoto ..... 271/236 X 5,014,977 5/1991 Moore et al. ..... 271/236 X

*Primary Examiner*—David H. Bollinger

[57] ABSTRACT

The present invention relates to a sheet registration system that uses a rigid arm having a sheet engaging surface to move sheets towards a registration position. The arm is mounted to a support member and is located adjacent a sheet store. The arrangement is such that relative movement between the support member and the sheet store causes the sheet engaging surface of the arm to engage a sheet in the sheet store. Pivoting of the arm then causes the sheet engaging surface to move the sheet into the registration position.

19 Claims, 4 Drawing Sheets

SHEET REGISTRATION DEVICE

Priority is claimed under United Kingdom Patent Application No. 9818928.5, entitled "Sheet Registration Device" filed on Aug. 28, 1998 by the same inventor.

FIELD OF THE INVENTION

The invention relates to a sheet registration device for moving sheets towards a registration position in a sheet store.

BACKGROUND OF THE INVENTION

Many sheet feeding apparatus such as image reproduction apparatus including photocopiers and the like feed sheets to a location such as a bin or tray for storing sheets (a "sheet store") for stacking purposes. It is particularly important in the case of intermediate stores such as duplex trays (used for intermediate storage during double-side photocopying) to ensure that the sheets are correctly registered for subsequent withdrawal. In the past, this has been achieved by making use of a paddle wheel assembly in which a number of flexible, rubber paddles or the like have been mounted on a rotatable shaft which rotates. This rotation causes the paddles to engage a sheet that has been delivered to a sheet store and move it towards a registration position. This prior art registration apparatus is well known to those reasonably skilled in the art. Unfortunately, the use of a paddle wheel assembly of this type is undesirable because of the number of components required and because of the cost of replacing these components.

SUMMARY OF THE INVENTION

In accordance with one aspect of the present invention, there is provided a sheet registration system for aligning a sheet in a sheet store with a registration stop. The sheet registration system comprises an arm having a sheet engaging surface; a support member; a mounting mechanism for movably connecting the arm to the support member such that the sheet engaging surface is movable between being spaced apart from the sheet and being in contact with the sheet and, when in contact with the sheet, being moved toward the registration stop; and a drive mechanism operatively linked with the arm for controlling movements of the sheet engaging surface.

In accordance with another aspect of the present invention, there is provided a reprographic machine including an apparatus for aligning a sheet in a sheet store with a registration stop. The reprographic machine comprises an arm having a sheet engaging surface; a support member; a mounting mechanism for movably connecting the arm to the support member such that the sheet engaging surface is movable between being spaced apart from the sheet and being in contact with the sheet and, when in contact with the sheet, being moved toward the registration stop; and a drive mechanism operatively linked with the arm for controlling movements of the sheet engaging surface.

In accordance with another aspect of the present invention, there is provided a method for aligning a sheet in a sheet store with a registration stop, such method comprising moving an arm having a sheet engaging surface from a retracted position spaced apart from the sheet to a position in which the sheet engaging surface contacts the sheet; and, when the sheet engaging surface is in contact with the sheet, moving the sheet engaging surface toward the registration stop.

Other aspects of the present invention will become apparent in the following detailed description of the invention and upon reference to the drawings.

BRIEF DESCRIPTION OF THE DRAWINGS

An example of a sheet registration device and image processing equipment incorporating such a device will now be described with reference to the accompanying drawings, in which.

DETAILED DESCRIPTION OF THE INVENTION

Inasmuch as the art of electrophotographic printing is well known, the various processing stations employed in the FIG. 1 printing machine will be shown hereinafter and their operation described briefly with reference thereto.

Figure 1:
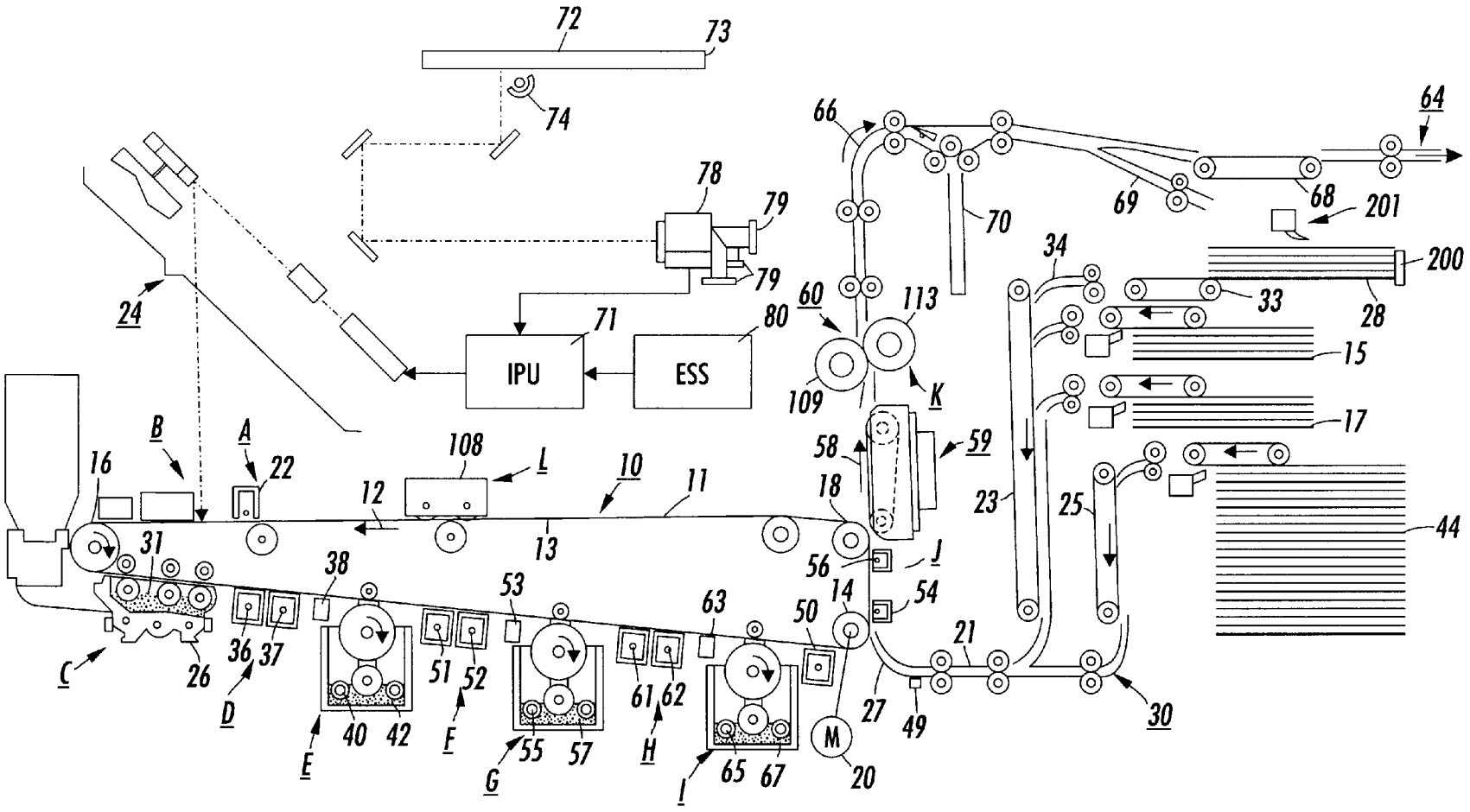
FIG. 1 is a schematic elevational view of an electrophotographic printing machine incorporating the sheet registration device.

Turning now to FIG. 1, the color copy process typically involves a computer generated color image which may be conveyed to an image processor (IPU) 71, or alternatively a color document 72 may be placed on the surface of a transparent platen 73. A scanning assembly having a light source 74 illuminates the color document 72. The light reflected from document 72 is reflected to three charged-coupled linear photosensing devices (CCDs) 79 where image information is read. Each CCD 79 outputs a digital two byte number that is proportional to the strength of the incident light. The digital numbers represent each pixel (picture element) and are indicative of blue, green, and red densities. They are conveyed to the IPU 71 where they are formed into bit maps comprising yellow, cyan, magenta, and black. One skilled in the art will recognize that each bit map represents the exposure, color component, and color separation for each pixel. The IPU 71 stores the bit maps for further instructions from an electronic subsystem (ESS) 80. The ESS is a self-contained, dedicated mini-computer having a central processing unit (CPU), electronic storage, and a display or user interface (Ul). ESS 80 is the main multitasking processor for operating all of the other machine subsystems and printing operations to be described hereinafter. These operations include imaging, developing, sheet delivery and transfer, plus various functions associated with subsequent finishing processes. Some or all of these subsystems may have additional micro-controllers that communicate with ESS 80.

The printing machine employs a photoreceptor 10 in the form of a belt having a photoconductive surface layer 11 on an electroconductive substrate 13. Preferably the surface 11 is made from an organic photoconductive material. The substrate 13 is preferably made from an aluminum overcoated polymer that is electrically grounded. The belt 10 is driven by means of motor 20 having an encoder attached thereto (not shown) to generate a machine timing clock. Photoreceptor 10 moves along a path defined by rollers 14, 18, and 16 in a counter-clockwise direction as shown by arrow 12.

Initially, photoreceptor 10 passes through charging station A where a corona generating device, indicated by reference numeral 22 charges photoreceptor 10 to a relatively high and substantially uniform potential.

Next, the charged portion of photoreceptor 10 advances to an imaging station B. Imaging station B exposes photoreceptor 10 to scanning device 24 to discharge the photoreceptor in accordance with the output of the scanning device. The scanning device comprises a laser Raster Output Scanner (ROS). The ROS creates an image in a series of horizontal scan lines having a certain number of pixels per inch. The ROS includes a laser, a polygon mirror, and a suitable modulator (or in lieu of a ROS, a light emitting diode array (LED) write bar may be used).

At development station C, a magnetic brush developer unit indicated by reference numeral 26 advances developer material 31 into contact with the latent image and latent target marks. Developer unit 26 has a plurality of magnetic brush roller members therein that transport black toner particles to the images for development thereof.

Thereafter, two corona recharge devices 36 and 37, at recharging station D, adjust the voltage levels on photoreceptor 10 to a substantially uniform level. This eliminates the voltage differences between the toned and untoned areas. An imaging station 38 then records a second electrostatic latent image on photoreceptor 10.

At development station E, a developer unit indicated by reference numeral 42 advances developer material 40 having yellow toner particles therein into contact with the second latent image.

Next, corona recharge devices 51 and 52 adjust the photoreceptor voltages at recharging station F to a single uniform level for development of a third image across a uniform electrostatic field. An imaging station 53 then records the third image on the photoreceptor. This image is developed using a magenta colored toner 55 contained in a developer unit 57 disposed at a third developer station G.

At a third recharging station H, corona recharge devices 61 and 62 adjust the photoreceptor voltages to a single uniform level for development of a fourth image across a uniform electrostatic field. An imaging station 63 records the fourth image on the photoreceptor. This image is developed using a cyan colored toner 65 contained in a developer unit 67 disposed at a fourth developer station 1.

The developer units 42, 57, and 67 are preferably of the type known in the art which do not interact, or are only marginally interactive with previously developed images. A DC jumping development system, or a powder cloud development system, or a sparse, non-contacting magnetic brush development system are each suitable for use in an image-on-image color development system.

The imaging stations 38, 53, and 63 superimpose subsequent images over the preceding images by selectively discharging the recharged photoreceptor. These imaging stations are similar to imaging station B.

In order to condition the toner for effective transfer to a copy media, a pre-transfer corotron member 50 charges toner particles on photoreceptor 10 to a required magnitude and polarity that ensures proper transfer to the copy media.

A copy media, such as a sheet of paper or a transparency, is advanced to transfer station J by a sheet feeding apparatus 30. During simplex operation (single-sided copy), blank media feeds from tray 15 or tray 17, or a high capacity tray 44 thereunder to a registration transport 21. The registration transport 21 properly positions the sheet with respect to the process and lateral directions, and adjusts the sheet for skew position. Trays 15, 17, and 44 may each hold a different media type. Alternatively, a wide variety of transparencies can be run through the machine from any one of these trays.

The velocity of the copy media is adjusted at registration transport 21 so that the sheet arrives at transfer station J in synchronization with the image on the surface of photoconductive belt 10. Registration transport 21 receives the media from either a vertical transport 23 or a high capacity tray transport 25 and moves the received media to a pre-transfer baffle 27. The vertical transport 23 receives the media from either tray 15 or tray 17, or the single-sided copy from duplex tray 28, and guides it to the registration transport 21 by way of a turn baffle 29.

The pre-transfer baffle 27 guides the media past registration transport 21 to transfer station J. Transfer station J includes a transfer corona device 54 which sprays oppositely charged ions onto the backside of the copy media. This attracts the charged toner powder images from photoreceptor belt 10 to the media. A detack corona device 56 is provided for facilitating stripping of the media from belt 10.

After the lead edge of the copy media strips away from the photoconductive surface of belt 10, it travels beneath a prefuser vacuum transport (PFT) 59 in the direction of arrow 58. The PFT 59 receives the copy media with an unfused image thereon and advances it to fusing station K. The drive force applied to the copy media by PFT 59 is a function of vacuum pressure, contact area (between PFT 59 and the copy media), and the coefficient of friction of a moving belt on PFT 59. One skilled in the art will recognize that the photoreceptor holding force is a function of the charging parameters of corona generators 54 and 56, the tack zone area between the corona generators, the velocity of the copy media, the geometry of the media path, and the copy quality requirements.

Fusing station K includes a fuser assembly, indicated generally by the reference numeral 60, which permanently fixes the transferred color images to the copy media. Preferably, fuser assembly 60 comprises a heated fuser roller 109 and a backup or pressure roller 113. The copy media passes between fuser roller 109 and backup roller 113 with the toner powder image contacting fuser roller 109. In this manner, the toner powder images are permanently fixed to the sheet.

After fusing, chute 66 guides the advancing media to feeder 68 for exit to a finishing module (not shown) at output 64. However, for duplex operation, the media is reversed in position at inverter 70 and transported to duplex tray 28 by chute 69. Duplex tray 28 temporarily collects the media and feeder 33 advances it to the vertical transport 23 through chute 34. The media fed from duplex tray 28 receives an image on the second side thereof, at transfer station J, in the same manner as the image was deposited on the first side thereof. The completed duplex copy exits to the finishing module (not shown) at output 64.

Figure 2:
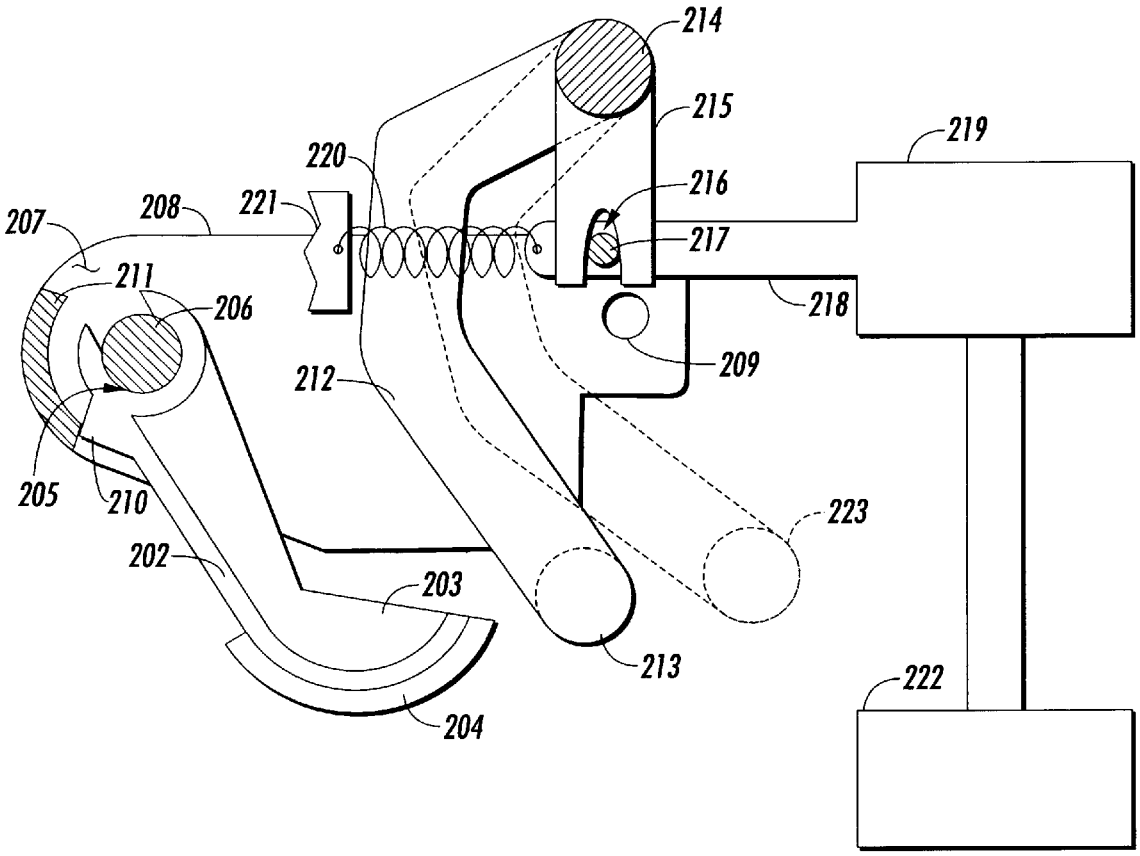
FIG. 2 is a schematic side elevation of the sheet registration device.

In order to ensure that sheets in the duplex tray 28 are correctly registered, a sheet registration device shown schematically at 201 is employed. This sheet registration device 201 is shown in more detail in FIG. 2. As shown in FIG. 2, the device comprises a bail arm 202 having a general L-shaped form with a curved sheet engaging surface 203 defined by a layer of high friction rubber 204. The arm 202 has a channel 205 formed at its upper end which snap fits, by virtue of the resilience of the plastics material from which the arm is made, onto a metal shaft or pivot pin 206. A loose fit is desirable to allow easy movement of the arm.

The pivot pin 206 extends between opposite walls 207 (only one shown in FIG. 2) of a support member 208 which is pivotally mounted on a shaft 209 journalled in a housing (not shown).

The support member 208 is shown in its retracted position in which the arm 202 depends downwardly under gravity and is held in the position shown by engagement between a boss 210 on the arm 202 and a stop 211 on the support member 208.

The support member 208 is held in its retracted position by a holding system. This holding system can take a variety of forms such as a pneumatic cylinder and the like but preferably includes a solenoid controlled link arm 212 which pivots between a holding position in which the support member is held in its retracted position and a released position. As shown in FIG. 2, the link arm 212 has a laterally extending pin 213 that extends under the support member 208. The link arm 212 is pivoted to a shaft 214 mounted to the housing and includes a depending, bifurcated arm 215 moulded to the arm 212. A slot 216 is defined by the arm 215 which receives a pin 217 mounted on an actuator arm 218 extending from a solenoid 219. The arm 218 is biased towards the position shown in FIG. 2 by means of a compression spring 220 extending between the arm and a part 221 of the housing.

The solenoid 219 actuates motion of the link arm 212 and is in turn actuated by a controller 222 which causes the arm 218 to retract into the solenoid against the bias of the spring 220 and thus causes the link arm 212 to pivot to the position shown in dashed lines at 223. This pivoting movement releases the support member 208 from engagement with the pin 213 thus allowing the support member to pivot downwardly to bring the arm 202 into engagement with the topmost sheet in the sheet store 28. One skilled in the art will readily understand that biasing and actuating may occur by reversing the actions of the spring and solenoid shown in FIG. 2. Also, the solenoid/spring biasing and actuating mechanisms may be implemented by any number of mechanisms such as stepper motors, cam and followers and similar mechanisms capable of moving and returning the arm 202.

Figure 3A:
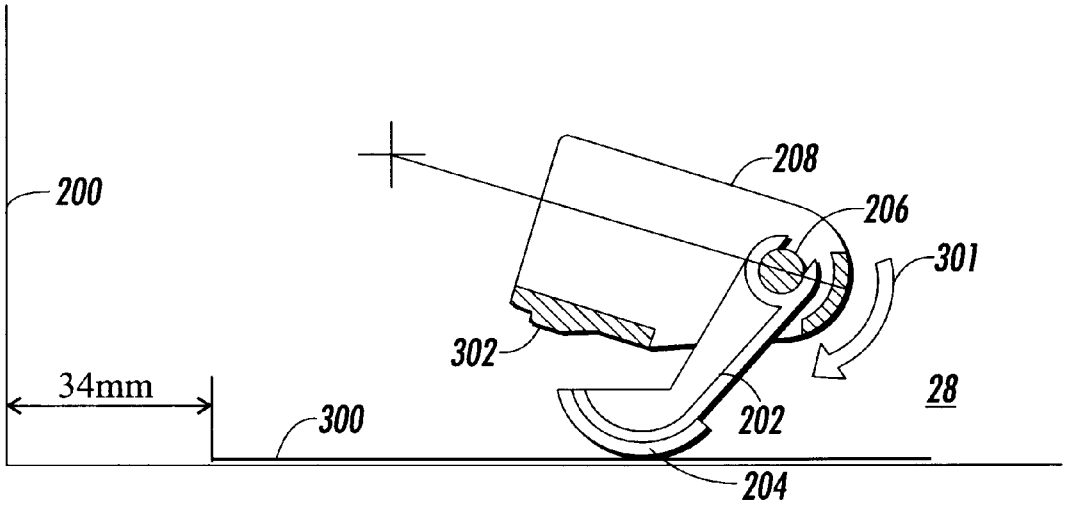
FIGS. 3A and 3B illustrate operation of the sheet registration device when there is a single sheet in the sheet store; and, FIGS. 4A and 4B are views similar to FIGS. 3A and 3B but with a number of sheets in the stack.
Figure 3B:
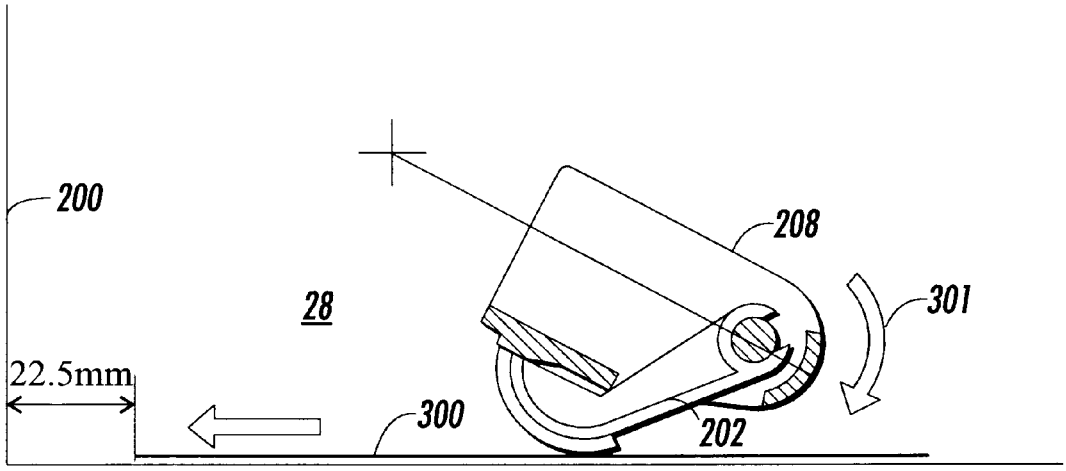

This operation of the arm 202 is shown in more detail in FIGS. 3 and 4. FIG. 3 illustrates a tray 28 with just one sheet 300 delivered by the transport system. Upon delivery of the sheet 300 to the sheet store 28 (which is determined in any conventional manner) the controller 222 actuates the solenoid 219 to allow the support member 108 to pivot downwardly in the direction of an arrow 301. Upon contact with the sheet (FIG. 3A) the assembly continues to lower causing the arm 202 to rotate about the pivot pin 206. This rotation causes the arm 202 to drive the sheet 300 forward towards the stop plate 200. This feed continues until the arm 202 reaches a stop 302 on the support member or the sheet is registered against the registration stop plate 200. The force driving the sheet is low enough such that when a sheet reaches registration, arm rotation stops and the sheet is not overfed or buckled. After a predetermined time interval, the controller 222 deactivates the solenoid 219 and the spring 220 pulls the actuator 218 back to the position shown in FIG. 2. This causes the pin 213 to engage the support member 208 and thus rotates the support member 208 and the arm 202 back to the retracted position.

Figure 4A:
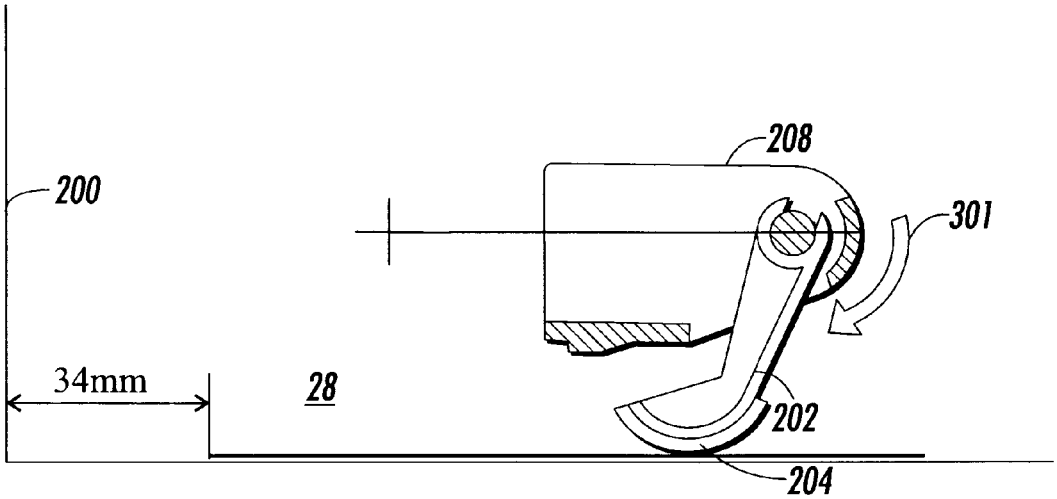
Figure 4B:
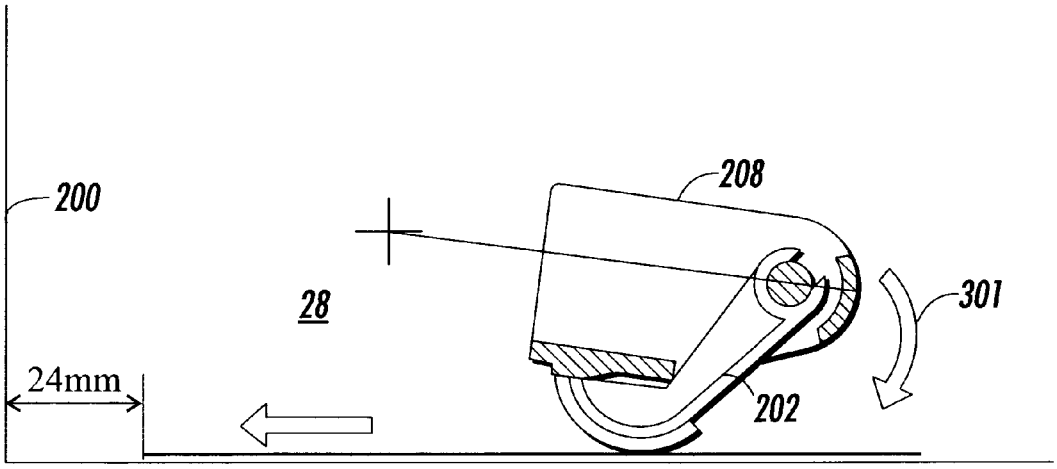

A similar sequence of operations occurs when the tray 28 is full as shown in FIGS. 4A and 4B. The sheet movement achievable by the arm is slightly less but is well within the tolerance that is required for registration.

There is a set minimum angle for the arm 202 on contact with the paper, the worst condition occurring with maximum stack height, at which angle there is not enough force to enable rotation causing the arm to stub the paper and not feed. However, the device can be designed so that this condition does not occur.

In this example, the arm 202 feeds paper in one axis towards the stop plate 200 but it is possible to reorientate the device so that it can feed the paper in two axes for both lead edge and side edge registration.

In review, the sheet registration system of the present invention includes an arm with sheet engaging surface, a support member which may be movably mounted to a housing, and a movable connection between the arm and support member such that the sheet engaging surface is movable between being spaced apart from the sheet and being in contact with the sheet and, when in contact with the sheet, being moved toward the registration stop. The sheet registration system of the present invention also includes a drive mechanism operatively linked with the arm for controlling movements of the sheet engaging surface. In a preferred embodiment, the present invention also includes a housing to which the support member is movably mounted. The drive mechanism actuates movement of the support member which, in turn, causes movement of the arm. The present invention may be used in any application where sheets are stacked in the sheet store but is particularly suitable for use in sheet feeding apparatus including a sheet transport system. The device may be oriented to move sheets in substantially the same direction as the delivery direction or it may be oriented to move sheets in a direction at an acute angle to the delivery direction, thus achieving registration against two orthogonal edges. When compared to registration apparatus of the prior art such as paddle wheel registration systems, the present invention has a simpler and lower cost construction and improved mechanical reliability.

It is, therefore, evident that there has been provided, in accordance with the present invention, a sheet registration system that fully satisfies the aims and advantages set forth above. While this invention has been described in conjunction with a preferred embodiment, it is evident that many alternatives, modifications, and variations will be apparent to those skilled in the art. Accordingly, it is intended to embrace all such alternatives, modifications and variations as fall within the spirit and broad scope of the appended claims.

What is claimed is:

1. A sheet registration system for aligning a sheet in a sheet store with a registration stop, comprising:

a) a housing;

b) support member movably mounted to the housing;

c) an arm having a sheet engaging surface, the arm being movably connected to the support member to enable the sheet engaging surface to move between a position spaced from the sheet and a position in contact with the sheet, with the sheet being moved toward the registration stop when the sheet engaging surface is in contact therewith; and d) a drive mechanism operatively linked with the arm for controlling movement of the sheet engaging surface.

2. The sheet registration system of claim 1, wherein the drive mechanism actuates movement of the support to control movement of the arm.

3. The sheet registration system of claim 1, wherein the sheet engaging surface comprises an arcuate portion.

4. The sheet registration system of claim 1, wherein movement of the sheet engaging surface exerts a force upon the sheet less than a force required to buckle the sheet against the registration stop.

5. The sheet registration system of claim 1, wherein the sheet has a lead edge and a side edge with the sheet engaging surface cooperating with the registration stop to position both the lead edge and the side edge of the sheet.

6. The sheet registration system of claim 1, wherein the drive mechanism further comprises a biasing mechanism for imparting a biasing force acting upon the support member and an actuating mechanism that, when actuated, imparts an actuating force greater than the biasing force.

7. The sheet registration system of claim 6, wherein the actuating mechanism comprises a solenoid.

8. The sheet registration system of claim 2, further comprising a holding mechanism that moves between a first position retaining the support member in a retracted position and a second position releasing the support member from the retracted position, wherein the drive mechanism operates upon the holding mechanism to cause movement between the first and second position.

9. A reprographic machine including a system for aligning sheets in a sheet store with a registration stop, comprising:

a) a housing;

b) a support member movably mounted to the housing;

c) an arm having a sheet engaging surface, the arm being movably connected to the support member to enable the sheet engaging surface to move between a position spaced from the sheet and a position in contact with the sheet, with the with the sheet being moved toward the registration stop when the sheet engaging surface is in contact therewith; and d) a drive mechanism operatively linked with the arm for controlling movement of the sheet engaging surface.

10. The reprographic machine of claim 9, wherein the drive mechanism actuates movement of the support member to control movement of the arm.

11. The reprographic machine of claim 9, further comprising holding mechanism that moves between a first position retaining the support, member in a retracted position and a second position releasing support member the retracted position, wherein the drive mechanism operates upon the holding mechanism to cause movement between the first and second position.

12. The reprographic machine of claim 9, wherein the drive mechanism further comprises a biasing mechanism for imparting a biasing force and an actuating mechanism that, when actuated, imparts a force greater than the biasing force.

13. The reprographic machine of claim 12, wherein the actuating mechanism comprises a solenoid.

14. The reprographic machine of claim 9, wherein the sheet engaging surface comprises an arcuate portion.

15. The reprographic machine of claim 9, wherein movement of the sheet engaging surface exerts a force upon the sheet less than a force required to buckle the sheet against the registration stop.

16. The reprographic machine of claim 9, wherein the sheet has a lead edge and a side edge with the sheet engaging surface cooperating with the registration stop to position both the lead edge and the side edge of the sheet.

17. A method of aligning a sheet in a sheet store with a registration stop, comprising:

a) moving an arm having a sheet engaging surface from a retracted position spaced from the sheet to a position in which the sheet engaging surface contacts the sheet; and b) when the sheet engaging surface is in contact with the sheet, moving the sheet engaging surface toward the registration stop.

18. The method of claim 17, further comprising moving a support member that is movably connected to a housing and to the arm, wherein movement of the support member causes the arm to move from the retracted position into contact with the sheet.

19. The method of claim 17, further comprising controlling movements of the arm by a drive mechanism operatively linked with the arm.

* * * * *